US008313179B2

(12) United States Patent
Hanson

(10) Patent No.: US 8,313,179 B2
(45) Date of Patent: Nov. 20, 2012

(54) LIQUID DELIVERY FOR A PRINTHEAD

(75) Inventor: Spencer R. Hanson, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 408 days.

(21) Appl. No.: 12/769,863

(22) Filed: Apr. 29, 2010

(65) Prior Publication Data

US 2011/0267406 A1 Nov. 3, 2011

(51) Int. Cl.
*B41J 2/175* (2006.01)

(52) U.S. Cl. ..... 347/85

(58) Field of Classification Search ..... 347/84, 347/85, 86, 87
See application file for complete search history.

(56) References Cited

U.S. PATENT DOCUMENTS

| | | | | |
|---|---|---|---|---|
| 4,971,527 | A | 11/1990 | Dick | |
| 6,039,442 | A * | 3/2000 | Hagiwara et al. | 347/89 |
| 6,174,052 | B1 * | 1/2001 | Eremity et al. | 347/74 |
| 6,733,119 | B2 * | 5/2004 | Naniwa et al. | 347/89 |
| 7,467,860 | B2 | 12/2008 | Silverbrook et al. | |
| 7,669,990 | B2 * | 3/2010 | Murakami et al. | 347/84 |

* cited by examiner

*Primary Examiner* — Anh T. N. Vo

(57) ABSTRACT

In one embodiment, a system for delivering liquid to a printhead at a first elevation. The system includes a reservoir to hold liquid at a second elevation, which is below the first elevation. A pump delivers liquid from the reservoir to the printhead through a first line. A bypass valve diverts liquid from the first line when a pressure in the first line exceeds a predefined pressure. A vent coupled to the printhead at or above the first elevation vents the printhead to atmospheric pressure when the pump is off.

20 Claims, 6 Drawing Sheets

LIQUID DELIVERY FOR A PRINTHEAD

BACKGROUND

Many printing systems use inkjet printheads to controllably emit drops of liquid from nozzles onto a print medium to form a desired printed image. A multi-speed pump and complex control electronics are often used to maintain proper pressure at a printhead in a printing system. In addition, if air is ingested into the printhead through the nozzles, the printhead may be damaged and require replacement or repair, costing time and money.

DETAILED DESCRIPTION

Figure 1:
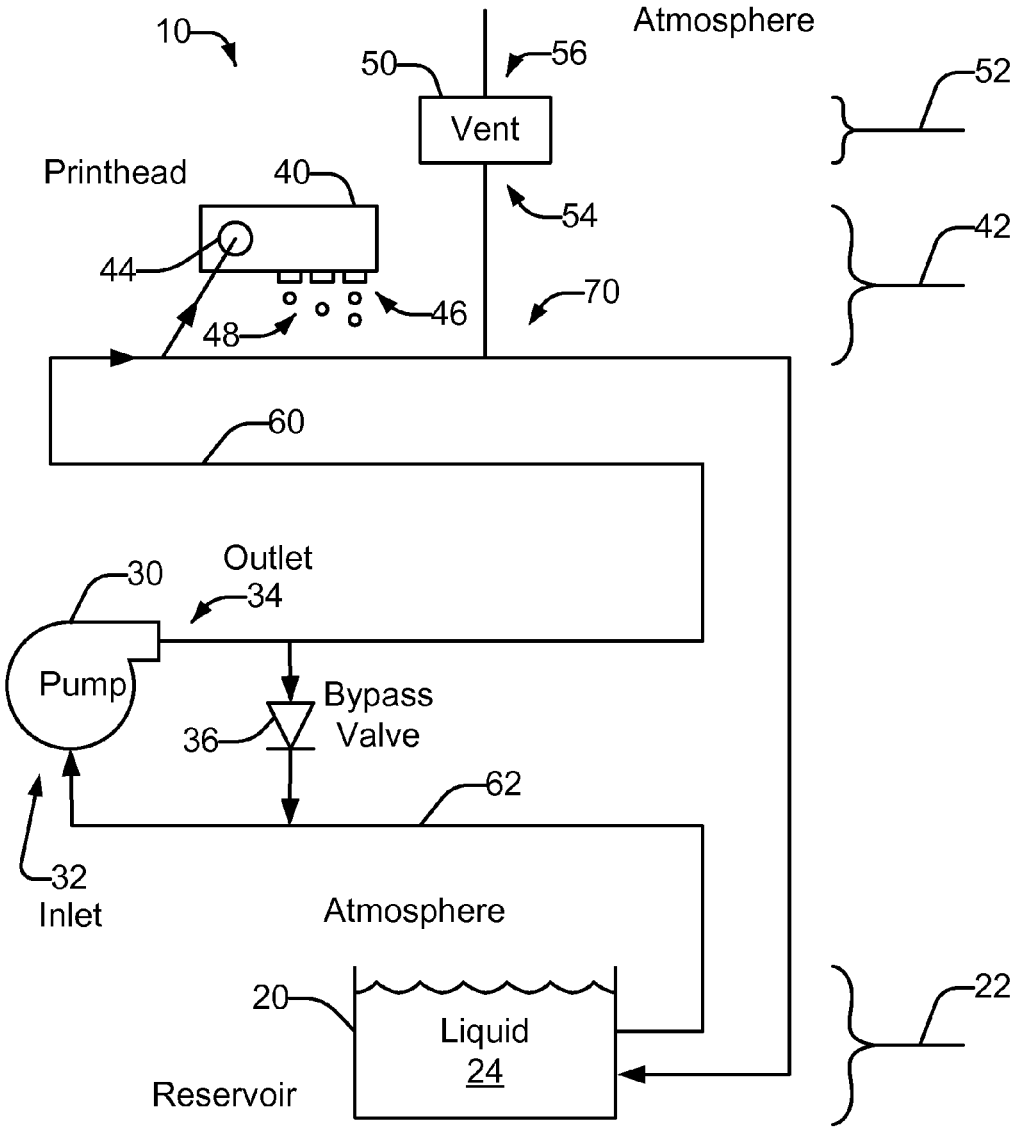
FIG. 1 is a schematic representation of a system for delivering liquid to a printhead, where the arrows indicate the direction of flow through the system in a print-ready mode, in accordance with an embodiment of the present disclosure.

Referring now to the drawings, there is illustrated an embodiment of a system for delivering liquid to a printhead which maintains appropriate pressure at the printhead in both a print-ready mode and a non-print-ready mode, and during transition from one mode to the other. By maintaining appropriate pressures, the system eliminates the ingestion of air into a printhead through its nozzles.

The liquid delivery system includes a printhead at a first, higher elevation, and a reservoir at a second elevation below the first elevation. During operation, a pump delivers liquid from the reservoir to the printhead through a line. Since a vent mechanism coupled to the printhead at or above the first elevation is closed to atmospheric pressure while the pump is on, the system pressurizes. When the pressure in the line exceeds a predetermined pressure, a bypass valve diverts liquid from the line, thus maintaining the pressure at the printhead in a range appropriate for the print-ready mode.

In the non-print-ready mode, the pump is turned off and the vent is opened to vent a liquid supply port of the printhead to atmospheric pressure and depressurize the line. During the transition from the print-ready mode to the non-print-ready mode, the tendency of the column of liquid in the line to fall back down into the reservoir, due to the vertical head pressure between the printhead and the reservoir due to gravity, tends to cause negative pressure in the line. Since the vent is opened to atmospheric pressure, air enters the line through the vent, which allows the liquid to return to the reservoir. In this way, any negative pressure experienced at the nozzles of the printhead is minimized if not eliminated, and thus air does not enter the printhead through the nozzles. As a result, in the non-print-ready mode the printhead is maintained at a non-negative pressure range lower than the first pressure range. Since the printhead does not undergo air ingestion through the nozzles and is maintained at a pressure level appropriate for the non-print-ready mode, the health and lifetime of the printhead for producing high quality print output is advantageously enhanced.

As defined herein and in the appended claims, a "liquid" shall be broadly understood to mean a fluid not composed primarily of a gas or gases. A "print ready mode" shall be broadly understood to mean a condition in which the liquid delivery system is in a state of readiness to print. A "non-print-ready mode" shall be broadly understood to mean a condition in which the liquid delivery system is not in a state of readiness to print, including one condition in which the liquid delivery system is powered off, and another condition in which the liquid delivery system is powered on for a servicing operation, such as, for example, accessing or replacing a printhead.

A variety of inkjet printing devices suitable for controllably emitting drops of a liquid onto a medium are commercially available. For instance, some of the printing devices in which the present disclosure may be embodied include inkjet printers, plotters, portable printing units, copiers, cameras, video printers, laser printers, facsimile machines, and all-in-one devices (e.g. a combination of at least two of a printer, scanner, copier, and fax), to name a few. Some of these printing devices print on discrete sheets of print media, such as paper. The present disclosure may also be embodied in a web press, typically a high volume, high speed printing system that uses large quantities of inks and, in some embodiments, other fluids. The web press prints on a roll of print media as it flows past the printhead(s), typically printing on the entire width of the print media in a single pass as it flows through the press, without requiring any reciprocation of the printhead(s) across the width of the print media. In some web presses, the printhead(s) may be disposed about six feet higher in elevation than the reservoir. While ink is one type of liquid that is commonly emitted by inkjet printing devices, and some embodiments of the present disclosure may be illustrated or described with reference to ink, the present disclosure is not limited to use with ink, but can be used with a large variety of other liquids, including, but not limited to, print fixers, dyes, medications, and other agents in liquid form.

As understood with reference to FIG. 1, the liquid delivery system 10 includes a reservoir 20, a pump 30, a bypass valve 36, a first line 60, a printhead 40, and a vent mechanism or vent 50. The printhead 40 is disposed at a first elevation 42. The reservoir 20 is disposed at a second elevation 22 that is below the first elevation 42. The vent 50 is disposed at an elevation 52 that is at or above the first elevation 42. The pump 30 and bypass valve 36 are typically disposed at an elevation that is between the first elevation 42 and the second elevation 22. Alternatively, the pump 30 and bypass valve 36 may be disposed at an elevation that is below the first elevation 42. The elevations 22,42,52 are distinct from each other. The brackets illustrated in FIG. 1 for elevations 22,42,52 schematically indicate that the components bracketed thereby are all understood to be located at the corresponding elevation. An elevation 22,42,52 may be a single point of elevation, or alternatively may encompass a range of elevations. In one embodiment, first elevation 42 is more than 8 inches above second elevation 22. In another embodiment, first elevation 42 is approximately 3.5 to 6 feet above second elevation 22.

The printhead 40 receives liquid through a liquid supply port 44. The printhead 40 controllably ejects drops 48 of liquid from one or more nozzles 46 in response to control signals (not shown) supplied to the printhead 40. In one embodiment the printhead 40 may be a thermal inkjet printhead, while in another embodiment the printhead 40 may be a piezoelectric inkjet printhead. In one embodiment, in the print-ready mode the printhead 40 should be maintained in a pressure range at the liquid supply port 44 between 2 and 6 psi. In one embodiment, in the non-print-ready mode the printhead 40 should be maintained in a pressure range at the liquid supply port 44 between 0 and 1.5 psi. Deviating from these pressure ranges may cause the printhead to print improperly and/or fail. In particular, deviating from the non-print-ready mode pressure range through the application of a negative pressure may cause air to be ingested through the nozzles 46 and damage the printhead. While some printheads may be able to withstand slight negative pressures for a short time, such as −0.5 psi for up to about an hour, exposure to higher negative pressures, or longer exposure to negative pressure, will cause the printheads to fail. In thermal inkjet printheads, negative pressure within the printhead body would pull air into the nozzles and the firing chamber. The printheads rely on capillary action for refilling a firing chamber after a liquid drop has been emitted therefrom, and air ingestion prevents the capillary refilling action from occurring. Consequently, further attempts to emit liquid from the associated nozzle will be unsuccessful.

The reservoir 20 is configured to hold a supply of liquid 24. The reservoir 20 is open to atmosphere, and is not pressurized during operation. Liquid is provided to an inlet 32 of the pump 30 through a line 62. The pump 30 conveys the liquid through line 60 to the printhead 40. As the pump 30 is typically overdriven, pumping more liquid than is being printed, some of the liquid is returned to the reservoir 20 via line 60, forming a recirculating liquid delivery system.

The pump 30 may be a single-speed pump. An example pump 30 has a maximum flow rate of 2.5 liters per minute. The pump 30 is powered on in the print-ready mode. Due to the flow resistance of the delivery system between the outlet 34 of the pump and the reservoir 20, pressure in the line 60 tends to increase. In order to maintain the pressure in the line 60, and thus at the printhead 40, in a range suitable for printing, a bypass valve 36 is disposed in parallel with the pump 30, between lines 60-62. The bypass valve 36 allows flow in a single direction therethrough, from line 60 to line 62. The bypass valve 36 does not allow flow therethrough in the opposite direction. The bypass valve 36 opens to allow liquid flow therethrough when the pressure in line 60 exceeds a predetermined pressure. In some bypass valves 36 this predetermined pressure, also referred to as the cracking pressure, may be manually set. As liquid is diverted from the line 60 back to the line 62 and inlet 32, the pressure in the line 60 is relieved. If the pressure in the line 60 drops below the predetermined pressure, as may occur, for example, when the printhead 40 begins emitting a large quantity of liquid drops, the bypass valve 36 will close to prevent flow therethrough, thus allowing more liquid to be directed up to the printhead, and causing the pressure in line 60 to correspondingly increase. When the pressure in line 60 reaches the predetermined pressure once again, the bypass valve 36 reopens to allow flow therethrough. Thus the pressure of the recirculating liquid in line 60 and at printhead 40 is maintained by a balance between the overdriven pump 30, the backpressure of line 60, and the bypass valve 36. In addition, the combination of the pump 30 and the bypass valve 36 in the system 10 advantageously allows a simpler, less expensive, single-speed pump to be used in the liquid delivery system 10, instead of a more complex, more expensive, multi-speed pump. The bypass valve 36 advantageously maintains the print-ready mode pressure range in the line 60 without the need for complex, expensive control electronics to sense the line pressure and control the pump speed in a closed PID loop.

In some embodiments, the pump 30 and bypass valve 36 are combined in a single device. One such suitable device is diaphragm liquid pump part number UNF300 KP.27DC24, available from KNF Neuberger, Inc., Trenton, N.J.

The vent mechanism 50 has two ports. An inlet port 56 is open to the atmosphere. An outlet port 54 is coupled to the line 60. Flow through the vent 50 can occur from inlet port 56 to outlet port 54. Flow through the vent 50 does not occur from outlet port 54 to inlet port 56. The vent 50 can be controllably operated to be placed in one of two states, closed or open. In the print-ready mode, the vent 50 is closed to prevent flow therethrough while the pump 30 is on, which maintains the pressure in the line 60 in the desired range for printing. Flow of liquid through line 54 and vent 50 to the atmosphere is prevented. As will be discussed subsequently in greater detail with reference to FIG. 4, the vent 50 is opened to allow flow therethrough when the pump 30 is turned off, which allows air from the atmosphere to enter the line 60 and allow the liquid to drain back to the reservoir while preventing negative pressure at the printhead 40.

In some embodiments, lines 60-62 comprise flexible tubing. The tubing is of a composition suitable for use with the particular type of liquid, and of dimensions suitable to support a flow rate and provide a backpressure sufficient to achieve the print-ready pressure. One such suitable tubing is Bev-A-Line IV Tubing, part number 56312, available from U.S. Plastic Corp., Lima, Ohio, and manufactured by Thermoplastic Processes, Georgetown, Del.

Figure 2:
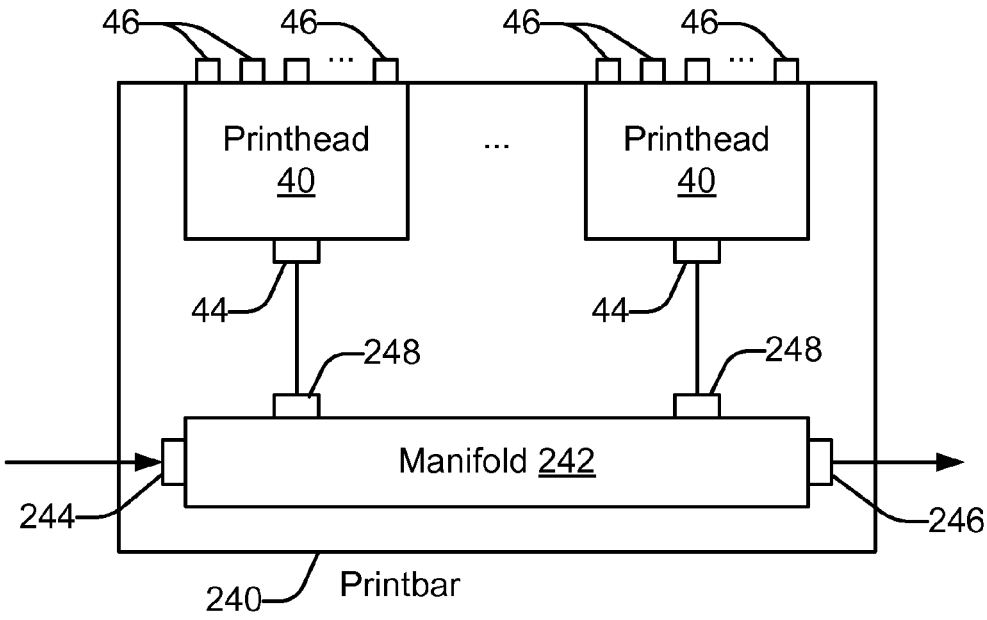
FIG. 2 is a schematic representation of a printbar including a printhead in accordance with an embodiment of the present disclosure.

As understood with reference to FIG. 2, in some embodiment one or more printheads 40 may be included in a printbar 240. For example, in a web press, the printbar 240 may include an arrangement of a number of printheads 40 sufficient to span the width of the roll of print media, such that a "full swath"—in other words, all locations of the media along a full width of the media—can be printed in a single pass of the printbar 240 over the media at that width. The printheads 40 are typically removable from the printbar 240, so that they can be individually replaced if and when needed.

An example printbar 240 includes a manifold 242 through which the liquid flows. The manifold 242 has an input port 244, an output port 246, and one or more printhead ports 248. In some embodiments the input port 244 and output port 246 may be reversible. Liquid is received at the manifold 242 from the input port 244. Liquid from the manifold 242 is supplied to the liquid supply port 44 of each printhead 40 via a corresponding printhead port 248. While manifold 242 is illustrated with two printhead ports 248, the manifold 242 may include one or more printhead ports 248. Liquid flowing into the manifold from the input port 244, in excess of the amount supplied to the one or more printheads 40, exits from output port 246, and may be provided to other components in the system 10, or returned to the reservoir 20.

Figure 3:
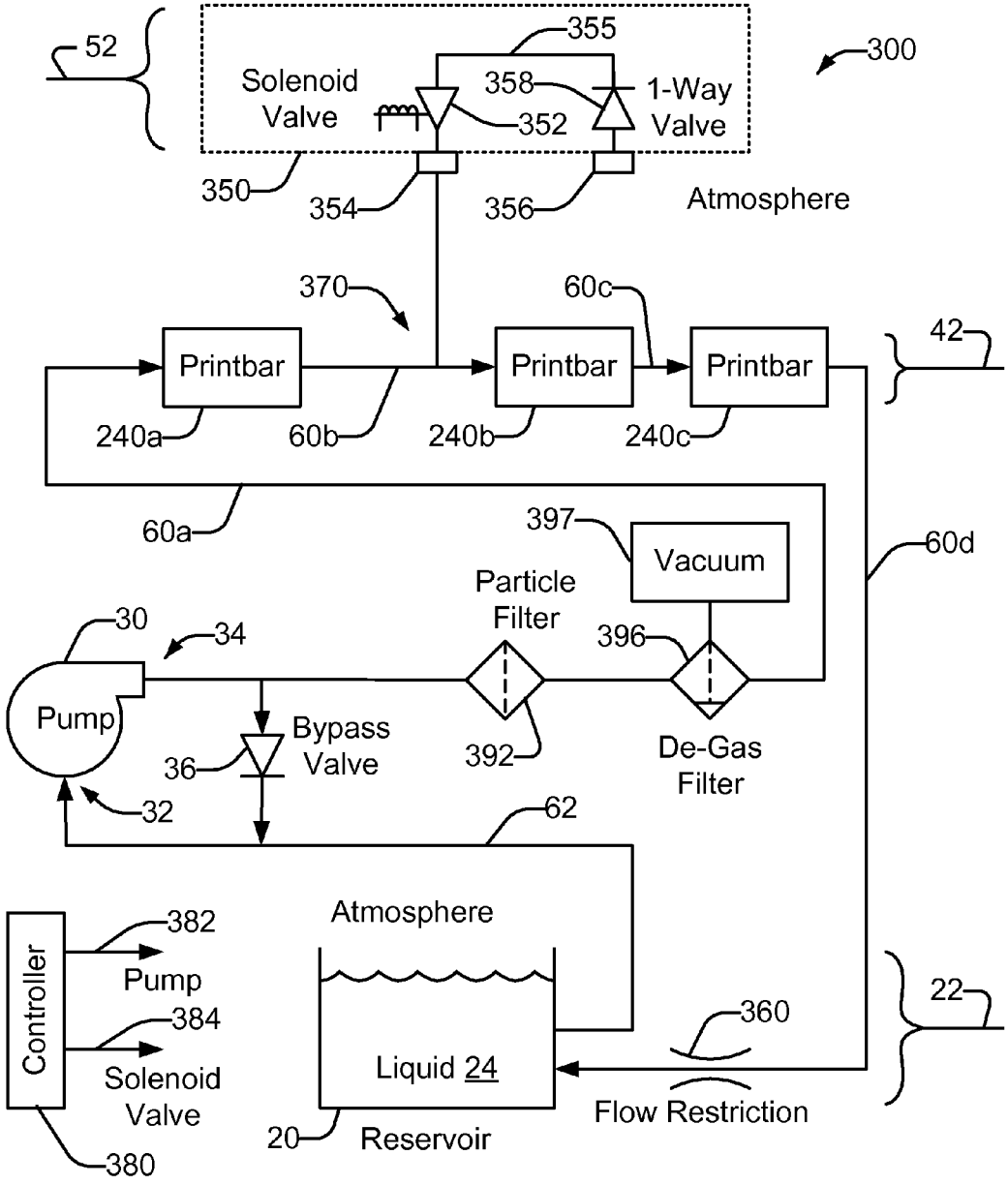
FIG. 3 is a schematic representation of a system for delivering liquid to the printbar of FIG. 2 in accordance with an embodiment of the present disclosure.

Considering now another embodiment of a liquid delivery system, and with reference to FIG. 3, the system delivers liquid to one or more printbars. The reservoir 20, liquid 24, pump 30, bypass valve 36, and line 62 are the same, similar, or analogous to those components as previously described with reference to FIG. 1, and are positioned in the system in the same or similar manner.

One or more printbars 240 are disposed at the first elevation 42; FIG. 3 illustrates three printbars 240*a*,240*b*,240*c*, for example. A vent mechanism or vent 350 is disposed at elevation 52 that is at or above first elevation 42. Elevations 52,42, 22 have the same or similar characteristics as previously described with reference to FIG. 1.

The inlet port 244 of printbar 240*a* is coupled to a segment 60*a* of line 60. The outlet port 246 of printbar 240*a* is coupled to a segment 60*b* of line 60. The inlet port 244 of printbar 240*b* is coupled to a segment 60*b* of line 60. The outlet port 246 of printbar 240*b* is coupled to a segment 60*c* of line 60. The inlet port 244 of printbar 240*c* is coupled to a segment 60*d* of line 60. The outlet port 246 of printbar 240*c* is coupled to a segment 60*d* of line 60. Thus printbars 240*a*,240*b*,240*c* are coupled in series in line 60. In one embodiment, one or more of the printbars may be configured to print on a first side of the media, while one or more others of the printbars may be configured to print on a second, opposite side of the media.

While line 60 provides a backpressure, a flow restriction 360 inserted in line 60 at a point further from the pump 30 than any of the printbars 240*a*,240*b*,240*c* increases the backpressure in line 60 and maintains the pressures at printbars 240*a*, 240*b*,240*c* all within a desired tolerance. The flow restriction 360 may be a fitting on or near the end of segment 60*d* of line 60. For example, in one embodiment line 60 is $\frac{1}{4}^{th}$ inch diameter tubing, while the fitting reduces the line to $\frac{1}{8}^{th}$ inch diameter.

Vent 350 has two ports. An inlet port 356 is open to the atmosphere. An outlet port 354 is coupled to the line 60. Flow through the vent 350 can occur from inlet port 356 to outlet port 354. Flow through the vent 350 cannot occur from outlet port 354 to inlet port 356. The vent 350 can be controllably operated to be placed in one of two states, closed or open. In the print-ready mode, the vent 350 is closed to prevent flow therethrough while the pump 30 is on, which maintains the pressure in the line 60 in the desired range for printing. Flow of liquid through line 354 and vent 350 to the atmosphere is prevented. As will be discussed subsequently in greater detail with reference to FIG. 4, the vent 350 is opened to allow flow therethrough when the pump 30 is turned off, which allows air from the atmosphere to enter the line 60 and allow the liquid to drain back to the reservoir while preventing negative pressure at the printheads 40 in printbars 240*a*,240*b*,240*c*.

Vent 350 includes a solenoid valve 352 coupled in series with a one-way valve 358. One-way valve 358 is arranged such that flow can occur through the vent 350 from inlet port 356 to outlet port 354, but not in the opposite direction. In some embodiments, outlet port 354 of vent 350 makes a T-connection 370 to line 60. FIG. 3 illustrates the T-connection 370 to line segment 60*b*, but in other embodiments the T-connection 370 may alternatively be made to one of line segment 60*a*,60*c*,60*d*. In some embodiments, the T-connection 370 is made at the first elevation 42, as illustrated in FIG. 3. In other embodiments where the first elevation 42 encompasses a range of elevations, the T-connection 370 may be made at the highest point within the first elevation 42. For example, the printbars 240*a*,240*b*,240*c* may be disposed along an arch, with the T-connection 370 made at the highest point of the arch.

While FIG. 3 illustrates solenoid valve 352 and one-way valve 358 at the same elevation relative to each other, in other embodiments one of the valves 352,358 may be disposed at a higher elevation than the other. In such embodiments, elevation 52 is understood as encompassing the elevations of both valves 352,358.

In one embodiment, one-way valve 358 is a mechanical valve that does not require electrical power to operate. For example, it may be a duckbill valve that includes a conical rubber flap similar in appearance to a duck's beak. Flow through the one-way valve 358 is enabled when the pressure at the inlet port 356 is slightly higher than the pressure at juncture 355 of the one-way valve 358 and the solenoid valve 352. When the pressure at juncture 355 is higher than the pressure at the inlet port 356, the one-way valve 358 mechanically seals. One such suitable device is part number VL1300-221, available from Vernay Laboratories, Yellow Springs, Ohio.

Solenoid valve 352 is an electrically-operated valve which can assume an opened state or a closed state, based on a control signal applied to the valve 352. The valve 352 is a normally-open valve so that, when power to the system 300 is off, the valve 352 will be open to allow flow therethrough. In one embodiment, the solenoid valve 352 has a low-power inductive coil and a small physical size. One such suitable device is part number 003-0194-900, available from Parker Precision Fluidics, Hollis, N.H. In one embodiment, the solenoid valve 352 is disposed at least 6 inches above the T-connection 370 in order to inhibit liquid from line 60 from reaching the valve 352. In another embodiment, the solenoid valve 352 is disposed 8 to 12 inches above the T-connection 370. About 12 inches of tubing are typically used in the line between the T-connection 370 and the outlet port 354 of the vent 350, which also inhibit liquid from line 60 from reaching the valve 352.

The series combination of the one-way valve 358 and solenoid valve 352 provides several advantages compared to using one or the other. First, mechanical one-way valves may slowly degrade, resulting in a slow leak through the valve in the opposite, undesired direction. Thus, a vent 350 that had the one-way valve 358 but not the solenoid valve 352 could be less reliable. Solenoid valves are typically more effective at preventing flow therethrough when the valve is closed, so putting a solenoid valve 352 in series with the one-way valve 358 increases the overall reliability of the vent 350. However, implementing the vent 350 using a solenoid valve 352 without the one-way valve 358 would be more complex. Opening the solenoid valve 352 at a time when the system is still under pressure would result in the undesirable emission of liquid from inlet port 356. In order to avoid this, the solenoid valve could not be opened until after the pressure in line 60 returned to atmosphere. However, this would require a different additional mechanism to vent the line 60, in order to avoid air ingestion through the nozzles 46 of the printhead(s) 40 in printbars 240, and a more complex control circuit to sequence the control of the solenoid valve relative to the pump and the additional vent mechanism(s).

The series combination of the one-way valve 358 and solenoid valve 352 allows a simplified control scheme. The system 300 includes a controller 380 that generates a pump control signal 382 and a solenoid valve control signal 384. The pump control signal 382 has a first state to turn the pump on and a second state to turn the pump off. The solenoid valve control signal 384 has a first state to close the valve to prevent flow therethrough and a second state to open the valve to allow such flow. As will be discussed subsequently in greater detail, in order to initiate the print-ready mode, the controller 380 sets both the pump control signal 382 and the solenoid valve control signal 384 to their respective first states, to turn the pump on and close the valve to prevent flow therethrough. In order to initiate the non-print-ready mode, the controller 380 sets both the pump control signal 382 and the solenoid valve control signal 384 to their respective second states, to turn the pump off and open the valve to allow flow therethrough. In the absence of power to the system 300, the pump is off and the valve assumes its normally-open state. In an embodiment, the pump control signal 382 and the solenoid valve control signal 384 are set to their respective first states substantially simultaneously. In an embodiment, the pump control signal 382 and the solenoid valve control signal 384 are set to their respective second states substantially simultaneously. Changing the control signals 382,384 substantially simultaneously simplifies the controller 350 by avoiding sequencing of the control signals 382,384 during a mode change, and avoiding the need to monitor a state of the system in order to time such a sequence.

As discussed heretofore, the entry of air into the printheads 40 can damage the printheads. Furthermore, during thermal inkjet printer operation, air that is dissolved into the liquid can come out of solution in the firing chamber during the firing process and damage the chamber. In addition, particles or other non-liquid contaminants in the liquid may similarly damage the printheads 40 by clogging or blocking the firing chambers or passages in the printheads 40. Thus some embodiments inhibit contaminants from entering the liquid. For example, while the reservoir 20 is illustrated schematically as a tank open to the atmosphere, reservoir 20 may be an enclosed container, bottle, or tank open to the atmosphere through a filtered vent. Other embodiments remove dissolved air and contaminants from the liquid. A system 300 that removes dissolved air and contaminants from the liquid before they reach the printheads 40 may advantageously be able to utilize less expensive, unfiltered or untreated liquids.

In some embodiments, the system 300 includes a particle filter 392. Typically, the filter 392 has a pore size of 0.5-1.0 micron, and removes particles and some bacteria. The filter 392 is typically formed of a material compatible with the liquid; for example, polypropylene in the case where the liquid is ink. One suitable particle filter 392 is Pentek® part number 158115 (for the housing) and 155255-43 for the cartridge, available from Pentair, Inc., Minneapolis, Minn.

In some embodiments, the system 300 includes a degas filter 396. A vacuum 397 is coupled to the degas filter 396. The degas filter 396 typically has a membrane that is hydrophobic relative to the liquid. The liquid is on one side of the membrane, while the vacuum 397 is applied to the other side of the membrane to pull the air out of the liquid. One suitable degas filter 396 is part number 2×6 Radial Flow SuperPhobic, available from Liqui-Cel®, Membrana-Charlotte, Charlotte, N.C.

Figure 4:
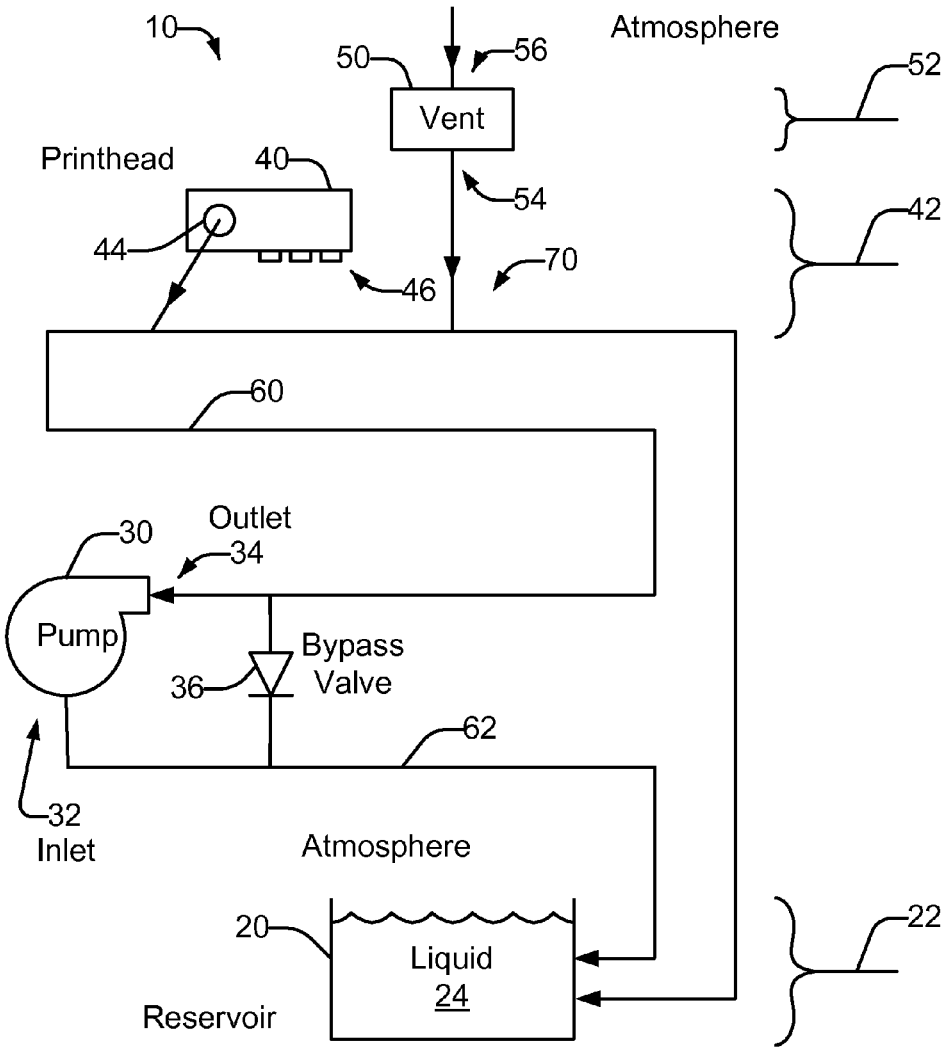
FIG. 4 is a schematic representation of the system of FIG. 1, where the arrows indicate the direction of flow through the system in a transition from the print-ready mode to a non-print-ready mode, in accordance with an embodiment of the present disclosure.

Considering now in greater detail the operation of the system in a transition from the print-ready mode to a non-print-ready mode, with reference to FIGS. 1 and 4, the arrows in lines 60,62 indicate the direction of flow through the system. FIG. 1 illustrates flow when the system 10 is operating in the print-ready mode, while FIG. 4 illustrates flow after the system 10 is transitioned from the print-ready mode into the non-print-ready mode. In the print-ready mode illustrated in FIG. 1, as explained heretofore, the pump 30 is on and the vent 50 is closed to prevent flow therethrough. The direction of liquid flow is from the reservoir 20 to the pump 30, then from the pump 30 through line 60, with a variable amount of the liquid entering printhead 40 via port 44 as needed, and the remainder of the liquid returned to reservoir 20. Also, bypass valve 36 diverts some of the liquid from line 60 to line 62 as it maintains the desired pressure in line 60.

To enter the non-print-ready mode, the pump 30 is turned off and the vent 50 is opened substantially simultaneously. With the pump 30 turned off, gravity causes the column of liquid that is in the line 60 at elevations above the reservoir 20 to tend to fall back down into the reservoir 20. This tendency causes negative pressure in the line 60. Since the vent 50 is opened to atmospheric pressure at the time the pump 30 is turned off, air from the atmosphere enters the line 60, flowing through the vent 50 in a direction from inlet 56 to outlet 54. The air provided through the vent 50 allows the liquid to return to the reservoir 20, and prevents a vacuum from being pulled on the printheads 40 thus preventing ingestion of air into the printhead 40 through the nozzles 46.

In one embodiment, the pressure in the line reaches substantially atmospheric pressure in 15 seconds or less. In an embodiment where the pressure in the line 60 is in the range of approximately 2 to 6 psi in the print-ready mode, the pressure in the line with the pump 30 off and the vent 50 open reaches the upper limit of the non-print-ready mode (1.5 psi) in approximately 5 seconds, and reaches substantially atmospheric pressure (0 psi) in approximately 10 seconds.

Liquid can drain from the line 60 back to the reservoir 20 through both paths from the T-connection 70 between the vent 50 and the line 60. It typically drains more slowly through the path that includes the pump 30 and line 62 than through the other path which returns directly to the reservoir. The bypass valve 36 is closed to prevent flow therethrough since the pressure in the line 60 is below the predetermined pressure. In some embodiments, it may take several hours for all the liquid from the line 60 to return to the reservoir 20. However, since the vent 50 remains open to atmosphere, no negative pressure is exerted on the printhead 40 during the draining process.

Figure 5:
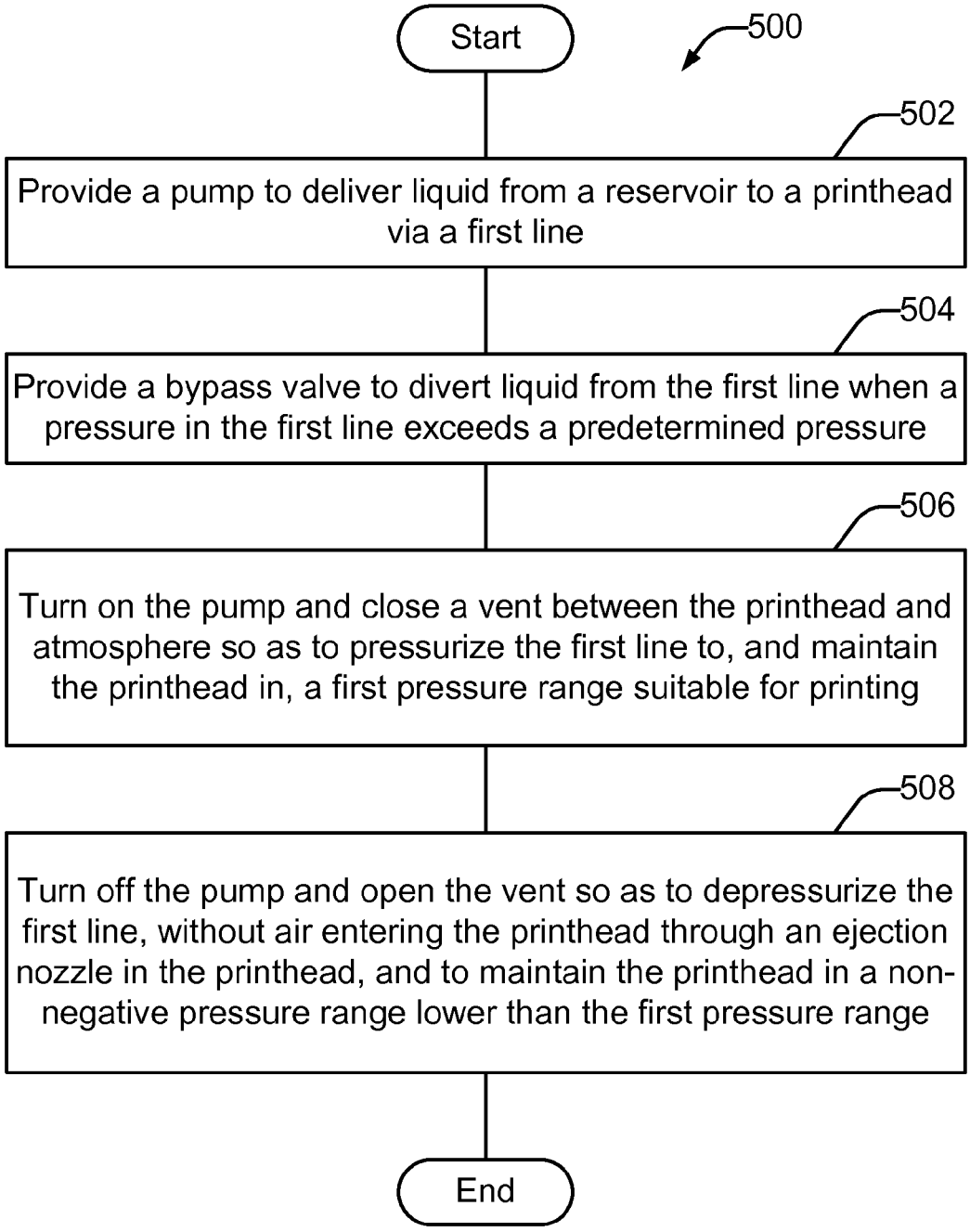
FIG. 5 is a flowchart in accordance with an embodiment of the present disclosure of a method of operating a printing system.

Considering now one embodiment of a method of operating a printing system, and with reference to FIG. 5, at a block 502 of a method 500, a pump to deliver liquid from a reservoir to a printhead via a first line is provided. In one embodiment, the printhead is disposed at a first elevation, and the reservoir is disposed at a lower second elevation. At block 504, a bypass valve to divert liquid from the first line when a pressure in the first line exceeds a predetermined pressure is provided. In an embodiment, the predetermined pressure is higher than atmospheric pressure, and the first pressure range includes the predetermined pressure. At block 506, the method 500 turns on the pump and closes a vent between the printhead and atmosphere so as to pressurize the first line to a first pressure range suitable for printing, and maintains the printhead in the first pressure range as a print-ready mode of the printing system. In some embodiments, the pump is turned on and the vent closed substantially simultaneously. At block 508, the method 500 turns off the pump and opens the vent so as to depressurize the first line, without air entering the printhead through an ejection nozzle in the printhead, and maintains the printhead in a non-negative pressure range lower than the first pressure range as a non-print-ready mode of the printing system. In some embodiments, the pump is turned off and the vent opened substantially simultaneously. In some embodiments, control of the pump and the vent in blocks 506,508 may be implemented by the controller 380. In an embodiment, control of the pump and the vent in blocks 508 may be implemented by turning off power to the printing system.

Figure 6:
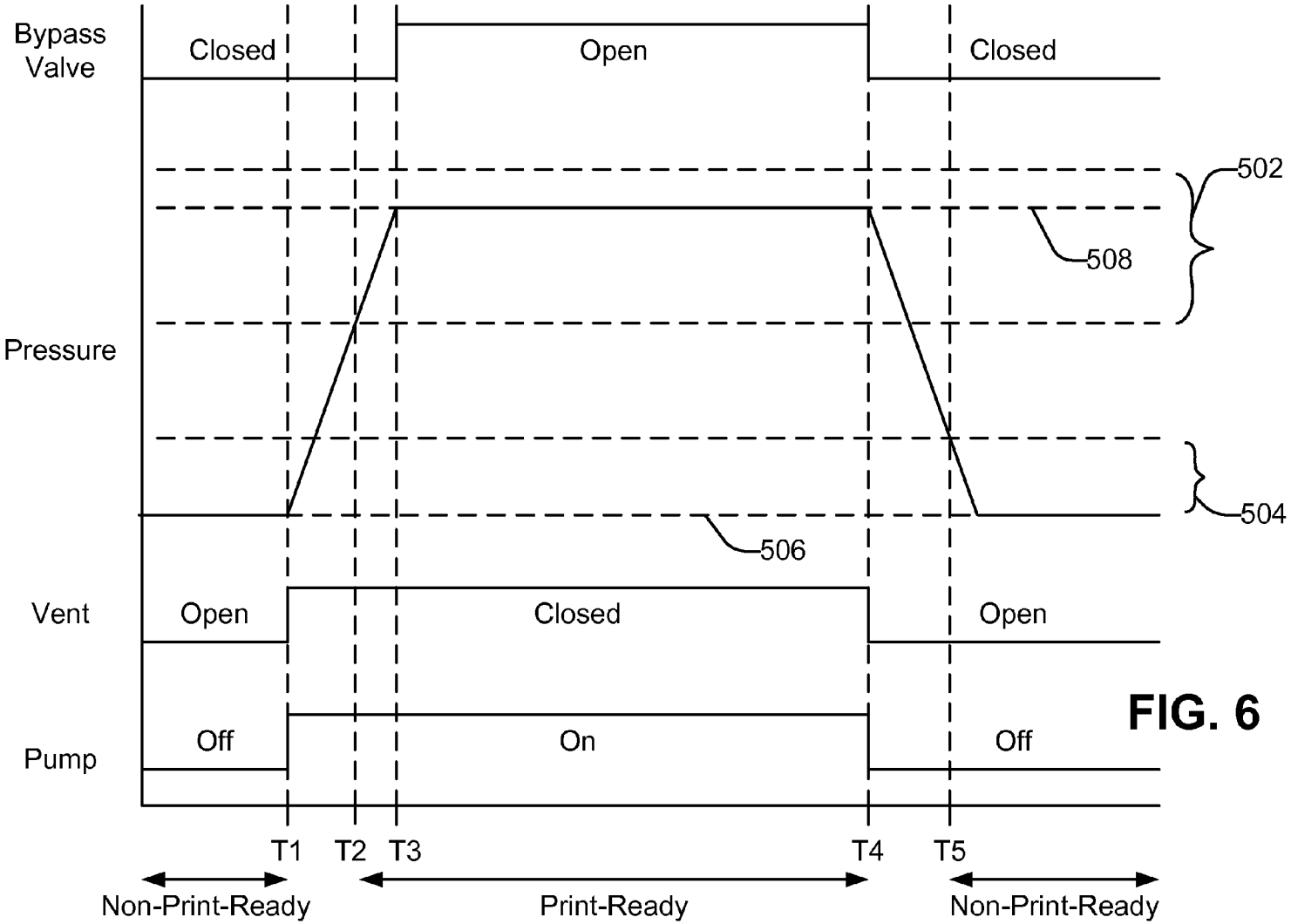
FIG. 6 is a schematic representation illustrating pressure in the system of FIG. 1 and FIG. 3 under certain operating conditions, in accordance with an embodiment of the present disclosure.

Consider now in further detail, and with reference to the schematic representation of FIG. 6, the pressure in the first line 60 (and at the printhead 40), and the state of the bypass valve 36, responsive to the state of the vent 50,350 and the pump 30. Assume that initially, prior to time T1, the pump is off and the vent is open to allow flow therethrough. The pressure is substantially equal to atmospheric pressure 506, and is within a non-negative pressure range 504 lower than pressure range 502. Thus, prior to time T1, the printing system is in the non-print-ready mode.

At time T1, the pump 30 is turned on and the vent 50 is closed substantially simultaneously. In response, pressure increases during a transition period between times T1 and T2. While the pressure increase is illustrated as linear, this is merely a schematic representation, and the actual pressure increase may occur in a non-linear manner. In one embodiment, the time period between T1 and T2 is about 10 seconds. Because the pressure is below the predetermined pressure 508, the bypass valve remains closed to prevent flow therethrough.

At time T2, the pressure enters pressure range 502 usable for printing, and the printing system enters the print-ready mode. The pressure continues to increase until time T3.

At time T3, the pressure reaches the predetermined pressure 508. In response, the bypass valve 36 opens to allow flow therethrough, diverting some of the liquid from line 60 to line 62. This reduces the pressure. The state of the bypass valve 36 maintains the pressure substantially at the predetermined pressure 508 during the time when the pump 30 is on and the vent 50 is closed, and the system is in the print-ready mode. While the pressure is illustrated as remaining constant until time T4, this is merely a schematic representation, as the actual pressure may decrease as the printhead 40 emits liquid, and if the pressure decreases below the predetermined pressure 508 the bypass valve 36 may close in order for the pump 30 to repressurize the system to the predetermined pressure 508. In addition, even if no liquid is being emitted from the printhead 40, there may be some oscillation in pressure around the level of the predetermined pressure 508.

At time T4, the pump 30 is turned off and the vent 50 is opened substantially simultaneously. With the pump 30 off, the printing system enters a transition period between times T4 and T5. As air from the atmosphere enters the line 60 through the open vent 50, the pressure drops. While the pressure decrease is illustrated as linear, this is merely a schematic representation, and the actual pressure decrease may occur in a non-linear manner. In one embodiment, the time period between T4 and T5 is about 5 seconds. Once the pressure falls below the predetermined pressure 508, the bypass valve closes to prevent flow therethrough.

At time T5, the pressure falls to the non-negative pressure range 504 lower than pressure range 502, and the printing system returns to the non-print-ready mode.

From the foregoing it will be appreciated that the systems and methods provided by the present disclosure represent a significant advance in the art. Although several specific embodiments have been described and illustrated, the disclosure is not limited to the specific methods, forms, or arrangements of parts so described and illustrated. This description should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Unless otherwise specified, steps of a method claim need not be performed in the order specified. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A system for delivering a liquid to a printhead at a first elevation, comprising:

a reservoir to hold the liquid at a second elevation below the first elevation;

a pump to deliver the liquid from the reservoir to the printhead through a line;

a bypass valve to divert the liquid from the line when a pressure in the line exceeds a predefined pressure; and a vent coupled to the printhead at or above the first elevation to vent a liquid supply port of the printhead to atmospheric pressure when the pump is off.

2. The system of claim 1, wherein the vent is closed to atmospheric pressure when the pump is on, and opened to atmospheric pressure when the pump is off.

3. The system of claim 1, wherein the vent is closed to atmospheric pressure when the pump is on to maintain the printhead in a first pressure range, and opened to atmospheric pressure when the pump is off to maintain the printhead in a non-negative pressure range lower than the first pressure range.

4. The system of claim 3, wherein the first pressure range includes the predetermined pressure.

5. The system of claim 1, wherein the line returns a liquid to the reservoir and includes a flow restriction to provide a backpressure, and wherein the vent is coupled to the printhead via a T-connection at or above the first elevation to the line.

6. The system of claim 1, wherein the reservoir is vented to atmospheric pressure.

7. The system of claim 1, wherein the vent comprises a solenoid valve in series with a one-way valve, the solenoid valve coupled to the printhead, and the one-way valve open to atmosphere.

8. The system of claim 7, wherein the one-way valve is oriented such that flow thru the vent from atmosphere to the printhead is allowed, and flow thru the vent from the printhead to atmosphere is prevented.

9. The system of claim 1, comprising a printbar adapted to mount the printhead, the printbar comprising:

a manifold having first and second ports to couple to the line such that the liquid can flow through the printbar when the printbar is disposed in the line; and a third port to couple to the liquid supply port of the printhead.

10. The system of claim 9, the printbar to mount a second printhead having a second liquid supply port, the printbar having a fourth port to couple to the second liquid supply port of the second printhead.

11. The system of claim 9, wherein the printbar comprises a plurality of printbars coupled in series.

12. A system for delivering a liquid to a printhead at a first elevation, comprising:

a reservoir to hold the liquid at a second elevation below the first elevation;

a pump to deliver the liquid from the reservoir to the printhead through a line;

a bypass valve to divert liquid from the line when a pressure in the line exceeds a predetermined pressure; and a vent coupled to the printhead at or above the first elevation, the vent closed to atmospheric pressure when the pump is on to maintain the printhead in a first pressure range, and opened to atmospheric pressure when the pump is off to maintain the printhead in a non-negative pressure range lower than the first pressure range.

13. The system of claim 12, wherein the vent comprises a solenoid valve in series with a one-way valve, the solenoid valve coupled to the printhead, and the one-way valve open to atmosphere.

14. The system of claim 13, wherein the one-way valve is oriented such that flow thru the vent from atmosphere to the printhead is allowed, and flow thru the vent from the printhead to atmosphere is prevented.

15. The system of claim 12, wherein the pump is a single-speed pump.

16. The system of claim 12, further comprising a particle filter and a degas filter disposed in the first line between the pump and the printhead.

17. A method of operating a printing system, comprising:

providing a pump to deliver a liquid from a reservoir to a printhead via a line;

providing a bypass valve to divert the liquid from the line when a pressure therein exceeds a predetermined pressure;

turning on the pump and closing a vent between the printhead and atmosphere to pressurize the line to a first pressure range suitable for printing; and turning off the pump and opening the vent to depressurize the line without air entering the printhead through an ejection nozzle thereof.

18. The method of claim 17, wherein the printhead is disposed at a first elevation, and the reservoir is disposed at a lower second elevation.

19. The method of claim 17, wherein the predetermined pressure is higher than atmospheric pressure, and wherein the first pressure range includes the predetermined pressure.

20. The method of claim 17, wherein the turning on the pump and closing the vent maintains the printhead in the first pressure range, and wherein the simultaneously turning off the pump and opening the vent maintains the printhead in a non-negative pressure range lower than the first pressure range.

* * * * *